US005484304A

United States Patent [19]

Capper et al.

[11] Patent Number: 5,484,304

[45] Date of Patent: Jan. 16, 1996

[54] ELECTRICAL CONNECTOR WITH WIRE INDICATOR AND WIRE RETAINER

[75] Inventors: Harry M. Capper; Sam Denovich, both of Harrisburg, Pa.; Kenneth C. Hawk, Clemmons, N.C.; David R. Radliff, Harrisburg; James W. Robertson, Oberlin, both of Pa.

[73] Assignee: The Whitaker Corporation, Wilmington, Del.

[21] Appl. No.: 254,402

[22] Filed: Jun. 6, 1994

[51] Int. Cl.[6] ..... H01R 4/24

[52] U.S. Cl. ..... 439/409; 439/441; 439/910

[58] Field of Search ..... 439/389–404, 439/409–413, 435–338, 441, 448, 709, 712, 713, 910

[56] References Cited

U.S. PATENT DOCUMENTS

| | | | |
|---|---|---|---|
| 4,039,239 | 8/1977 | Cobaugh et al. . | |
| 4,236,778 | 12/1980 | Hughes et al. . | |
| 4,557,544 | 12/1985 | Esser . | |
| 4,624,518 | 11/1986 | Seidel . | |
| 4,701,004 | 10/1987 | Yohn | 439/871 |
| 5,006,077 | 4/1991 | Loose et al. | 439/409 |
| 5,219,302 | 6/1993 | Robertson et al. | 439/404 |
| 5,254,808 | 10/1993 | Rodrigues et al. | 174/65 R |
| 5,317,474 | 5/1994 | Capper et al. | 361/119 |
| 5,321,577 | 6/1994 | Capper et al. | 361/119 |

FOREIGN PATENT DOCUMENTS

0529957A1 3/1993 European Pat. Off. .

OTHER PUBLICATIONS

*AMP Catalog 82257*, "AMP Quiet Front Terminal Block", Issued Sep. 1991; pp. 1 to 6; AMP Incorporated, Harrisburg, Pa.

U.S. Serial No. 07/955,535 filed Oct. 1, 1992 (Abstract and Drawings only included).

*Primary Examiner*—Khiem Nguyen

*Attorney, Agent, or Firm*—Anton P. Ness

[57] ABSTRACT

An electrical connector (10) including a housing (12) with a pair of housing sections (14) each containing a terminal (40) rotatable therewithin upon actuation to terminate an end of a wire (26,28) inserted into an aperture (22,24) thereof. For small diameter wires, a wiring indicator (60) of transparent material is affixed to the opposed side of the housing and includes a chamber (70) for each wire to be extended therethrough for termination, thus enabling visual verification that a wire end has been fully inserted. A wire retainer (90,100) is used to prevent inadvertent backout after full wire insertion but before termination. Wire retainer (100) can be a clip mountable outside the housing, and wire retainer (90) can be contained in the wiring indicator includes a spring arm (92) biasing against the wire free end (52) upon full insertion.

17 Claims, 5 Drawing Sheets

ELECTRICAL CONNECTOR WITH WIRE INDICATOR AND WIRE RETAINER

FIELD OF THE INVENTION

This is related to the field of electrical connectors and more particularly to connectors for use with electrical wires.

BACKGROUND OF THE INVENTION

The telecommunications industry utilizes a variety of electrical connectors in several different situations in which electrical connections must be made. One such situation is the providing of electrical connections between a telephone cable and a service cable at an individual customer site, mainly through use of a splice of the tip and ring signal wires of a drop wire from the main cable to respective house wires of the service cable at a junction located outside or inside the house. Ends of both the drop wire and the service cable enter an enclosure, and the tip and ring wires of each are interconnected or spliced to the tip and ring wires of the other in a terminal block, commonly termed a crossconnect block. Such a crossconnect block must not only provide dielectric protective structure around the splice, but together with the enclosure must provide protection from the environment, especially from water, dust, and other contaminants and also from insects and animals. Such enclosures must be capable of being reopened to expose the crossconnect blocks and other electrical connectors therein for service and repair as needed. Also, certain terminal blocks are utilized to provide protection of the individual circuits from voltage and current surges for safety reasons and for the protection of sensitive electrical and electronic equipment from damage.

One such crossconnect block is disclosed in U.S. Pat. No. 5,219,302. A dielectric housing includes a pair of tubular terminal-receiving housing sections each with an integrally molded center post therewithin extending upwardly from a common base section, thus defining an annular cavity within which is disposed a barrel-shaped terminal and a tubular actuator adapted to rotate the terminal from an unterminated position to a terminated position. Each housing section is provided with a pair of wire-receiving openings through side walls and into the cavity aligned with an aperture through the center post, and associated openings are provided in contact sections of the terminal and in the actuator that are aligned with the side wall openings when the terminal and actuator are ill the unactuated position. Slot walls of the terminal extend circumferentially from each wire-receiving opening and are precisely profiled to include constricted edges to penetrate the wire insulation and assuredly engage the conductor therewithin. During splicing, the wire ends of both tip wires (or both ring wires) are inserted into respective openings of the same housing section and through the apertured contact sections of the terminal and into the center post until stopped by abutment against a stop surface. Upon rotation of the rotatable terminal by the actuator such as through a quarter turn, slot walls of the terminal pierce the insulation of the respective wires and engage the respective conductors thereof, thus commoning and interconnecting them.

U.S. Pat. Nos. 5,317,474 and 5,321,577 both disclose a similar terminal block in which is contained one or two surge-protecting electrical components or protectors. The circuits of the wires terminated within the terminal block are provided-with protection against voltage and current surges by the protectors. Both terminal blocks utilize similar housing structure and terminals and actuators for the insulation displacement termination of unstripped wires as in U.S. Pat. No. 5,219,302.

In U.S. Pat. No. 5,219,302 and also in U.S. Pat. No. 5,006,077, such terminal blocks with rotatable terminals in annular housing cavities are adapted to accommodate wires of two particular sizes. While wire entrance apertures of the housing section sidewalls are wide enough to receive a larger 18 AWG size wire therethrough, the wire-receiving passageways of the center post are profiled to receive and stop the end of the 18 AWG wire at a tapered transition section located between the larger diameter forward passageway portion and a smaller diameter passageway portion. The tapered transition portion acts as a lead-in to prevent stubbing, to permit the end of a smaller 24 AWG wire to pass completely through and exit from the center post and continue therebeyond (and through apertures in the terminal and actuator) until stopped by a stop recess in the far annular cavity sidewall opposed from the wire entrance apertures. When the smaller diameter wire is thus extended completely through and beyond the center post, the far portion of the terminal through which the free end of the wire extends is provided with a smaller diameter slot to assuredly engage the smaller diameter conductor within the 24 AWG wire; the larger diameter slot adjacent the wire entrance is useful in biting into the insulation and establishing a strain relief protecting the termination from forces otherwise transmittable to the end of wire.

Quiet Front crossconnect and protected terminal blocks are sold commercially by AMP Incorporated and contain sealant material that embeds the terminal in each housing cavity (and the protector component, if any) and also embeds the end of each wire inserted into and terminated by the terminal block. Such sealant material is preferably gel-like and may be as disclosed in U.S. patent application Ser. No. 07/955,535 filed Oct. 1, 1992 and also may be one of several materials disclosed in European Pat. Publication No. 0 529 957 A1. It is common that regarding very small gage wires, once a wire end has been inserted into the housing section and then released to manually rotate the actuator for actuation of the terminal for termination to the wire end, such material, especially material of gel-like consistency tends to urge the inserted wire end at least partially out of the housing. Thus it is possible that the free end of the wire may be moved sufficiently toward the wire entrance that it no longer resides in the wire end recess of the cavity sidewall and may not become terminated upon rotation of the terminal.

It is desired to provide a terminal block filled with sealant material such as gel-like material, that permits an indication that the wire end is fully inserted.

It is desired to provide a terminal block filled with sealant material such as gel-like material, that assures that the wire end remains fully within the terminal block after insertion but prior to termination.

SUMMARY OF THE INVENTION

The present invention provides a means for enabling verification that the free end of a wire inserted into a terminal block remains fully inserted once released in order to actuate the actuator. Such verification is by visual inspection permitted by a wiring indicator provided along the outer surface of the housing section, formed of transparent material such as thermoplastic resin and including a wire-receiving cavity aligned with each wire-receiving aperture of the housing section and diametrically opposed therefrom and in communication with the annular cavity aligned with the wire passageway of the center post. Such wiring indicator may be a separate article molded and secured to the terminal block, such as by being latched thereto. Preferably the wiring indicator includes chambers defining wire-receiving cavities associated with all wire-receiving apertures of the terminal block, where all such apertures are along a common face of the terminal block and the wiring indicator is applicable to the opposed face of the terminal block. Preferably the sealant material is also transparent so that even when the wire-receiving cavities of the wiring indicator is also sealant-filled, the wire end is visible when fully inserted.

In another aspect of the present invention, a biasing means is provided in the terminal block engageable with the free end of a wire inserted into the terminal block upon full insertion through the aligned wire-receiving apertures of the housing section, terminal and actuator. Such biasing means may be a spring member secured within the terminal block along the face thereof opposed from the wire-receiving face. Alternatively the biasing means may be a clip securable about the terminal block with wire-retention sections adjacent the wire-receiving entrances, comprising a pair of spaced converging tabs extending toward the entrances deflected apart as a wire is urged between them and into the entrance.

Preferably the biasing means or wire retainer is secured within the wiring indicator member. In one embodiment of such an arrangement, one end of the wire retainer is secured to the assembly and a free end extends into the wire-receiving cavity angled across the insertion path for the wire. The free end is thus cantilevered and is deflectable against spring bias by the free end of the wire upon full insertion. The spring bias applied against the wire free end urges it against the far wall of the wire-receiving cavity and is sufficient to retain the wire free end within the cavity against the forces of the sealant material tending to urge the wire rearwardly along the insertion path and toward the wire-receiving entrance.

In one embodiment where the wiring indicator includes vertically aligned wire-receiving cavities (or a single large cavity) associated with an adjacent pair of wire-receiving entrances of a single housing section, a single wire retainer can include a pair of cantilever spring arms extending from a common body section secured within the wiring indicator, such that each cantilever spring arm traverses a respective wire insertion path and is deflectable by a respective wire free end.

It is one primary objective of the present invention to provide a means for verifying that the free end of a wire once inserted into a terminal block but prior to its termination, remains fully inserted thus assuring appropriate termination upon actuation of the terminal.

It is also an objective that such a wiring indicator result in a sealed terminal block.

It is a further objective to provide such a wiring indicator as a separate article easily securable to a terminal block.

It is a second primary objective of the present invention to provide a means for assuredly maintaining full insertion of a wire end once inserted into a terminal block and released, prior to termination.

It is an additional objective to provide a complementary arrangement of wiring indicator and wire retainer that both retains the wire fully inserted and enables verification of that full wire insertion condition, prior to and after termination.

Embodiments of the present inventions will now be disclosed by way of example with reference to the accompanying drawings.

DETAILED DESCRIPTION OF THE PREFERRED EMBODIMENTS

Figure 1:
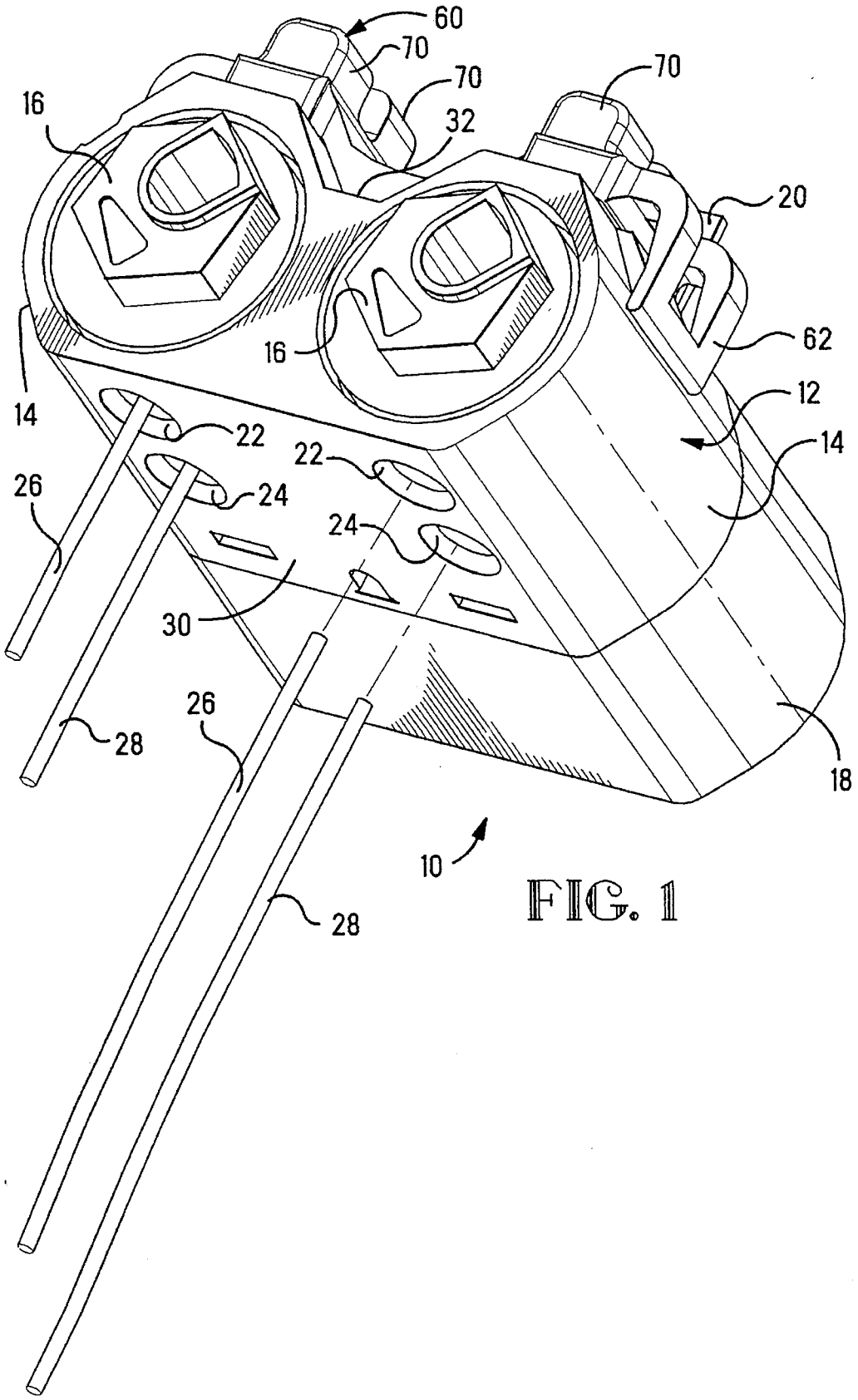
FIG. 1 is an isometric view of a terminal block having the wiring indicator of the present invention assembled thereto, with a pair of wires inserted thereinto for termination and splicing for interconnection to each other and an additional pair of wires about to be inserted thereinto for termination.
Figure 2:
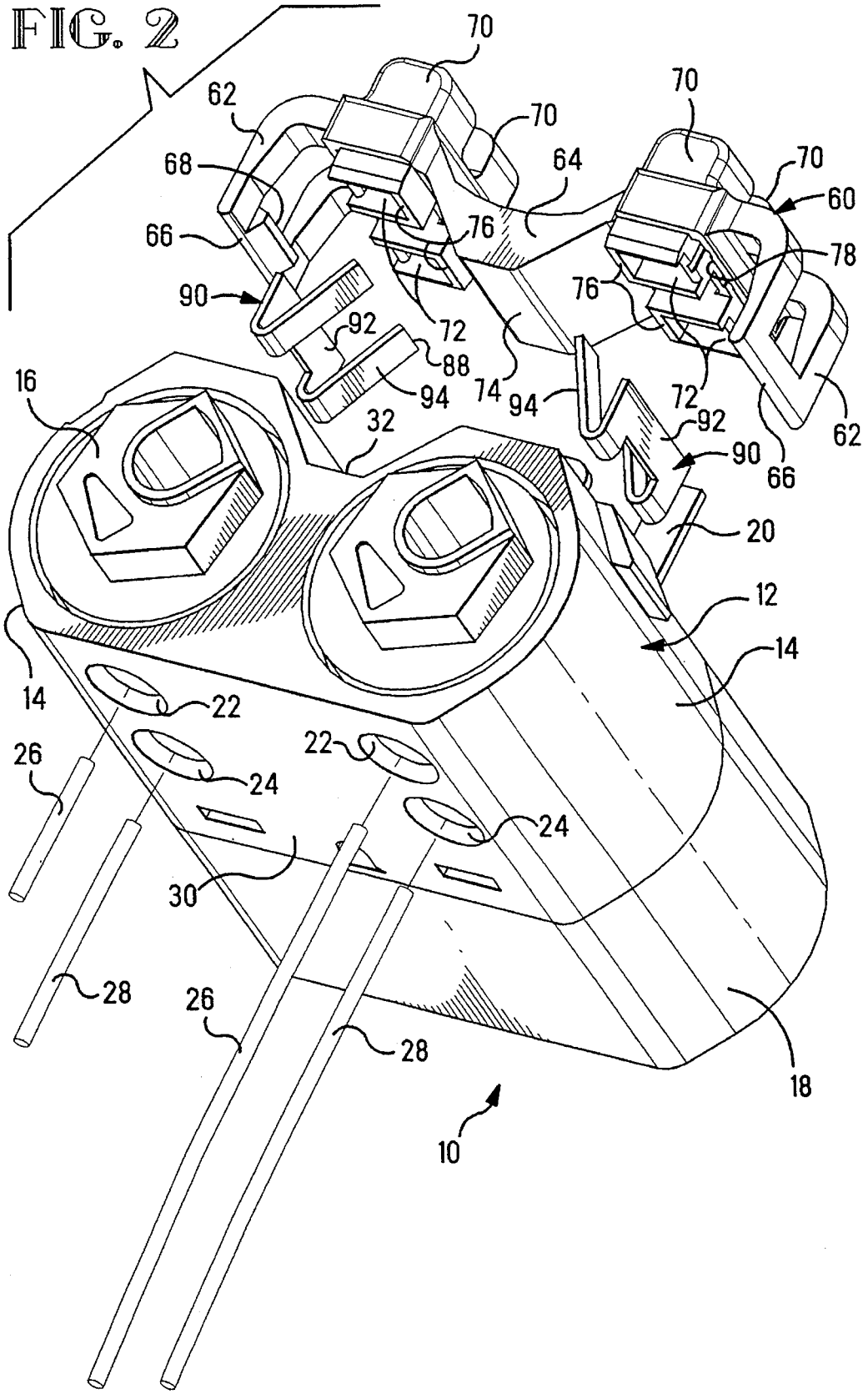
FIG. 2 is an isometric exploded view of the terminal block of FIG. 1 also showing a pair of wire retainers contained in the assembly.
Figure 3:
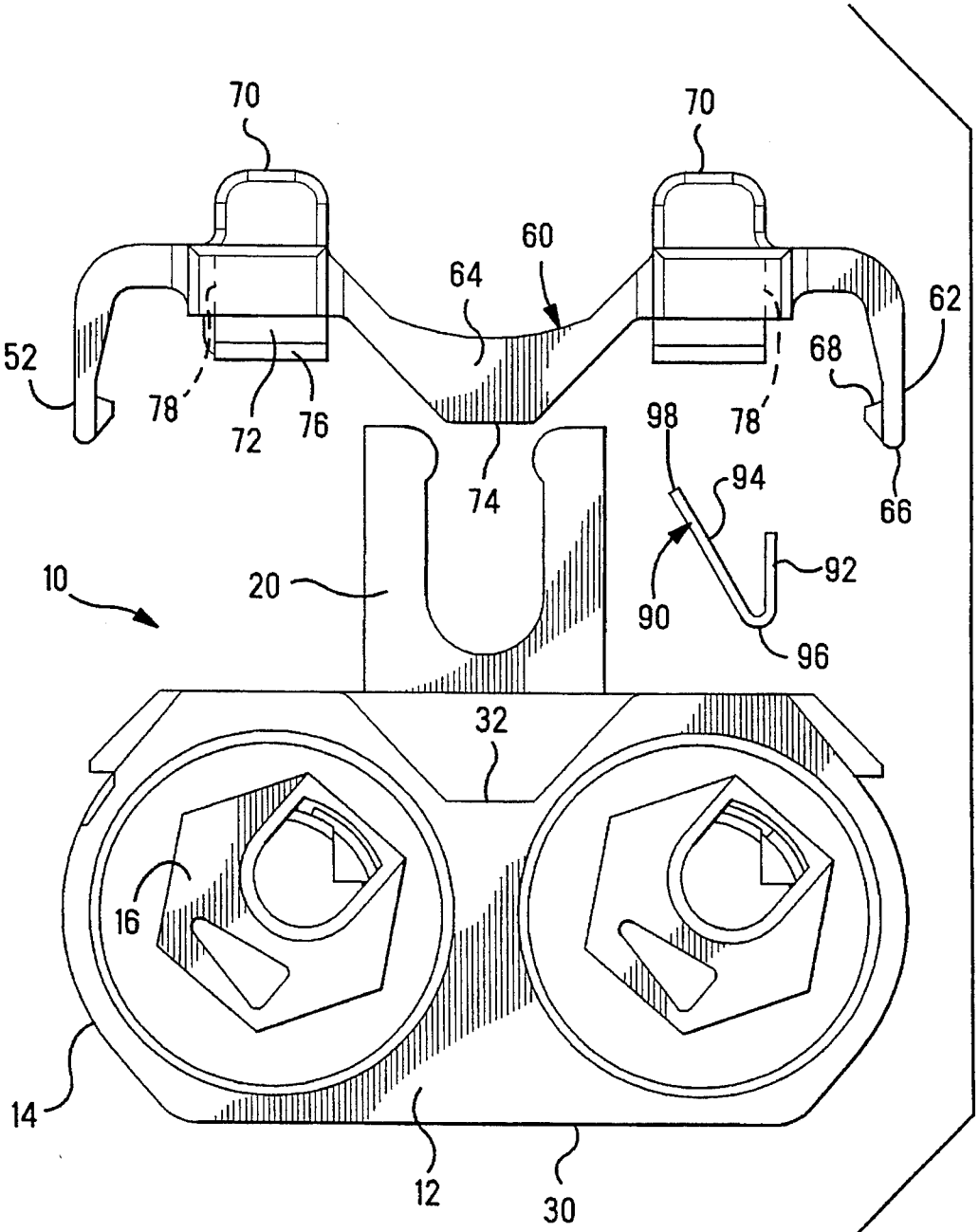
FIG. 3 is a plan view of the terminal block of FIGS. 1 and 2 with the wiring indicator and a wire retainer about to be assembled to the housing.

In FIG. 1 is shown a protected terminal block 10 having a housing assembly 12 including a pair of generally cylindrical housing sections 14 each having therewithin an annular cavity containing a barrel-shaped terminal and an actuator 16 therefor. A bottom cover 18 contains a protector unit (not shown) having leads electrically engaged with the respective terminals and also electrically connected to a ground contact section 18 seen extending from the assembly for connection to a system ground and also enabling mounting of the terminal block within an enclosure (not shown). Such a terminal block is disclosed with greater particularity in U.S. Pat. No. 5,317,474.

Each housing section 14 includes a pair of wire-receiving entrances 22,24 associated with respective wires 26,28 that are to be spliced or crossconnected to each other by the terminal within the housing section upon actuation, preferably with the wire-receiving entrances 22,24 of both housing sections being disposed along a common wire-receiving face 30 of the terminal block. Preferably contained within annular cavities of housing sections 14 is a sealant material, preferably gel-like, such as is disclosed in European Pat. Publication 0 529 957 A1 for example, a mixture of an elastomeric thermoplastic polymer such as a composite of diblock and triblock copolymers, and an extender such as a mixture of mineral oil and polyisobutene, and also may include silica and another polymer crosslinked with the elastomeric polymer. The sealant preferably contains corrosion inhibitors and suitable stabilizers such as antioxidants, and also preferably has memory properties, being able to absorb energy on being deformed and to return to its original state upon removal of the source of stress. Also, a tape element (not shown) may be adhered across wire-receiving face 30 of housing 12 with small apertures aligned with larger wire-receiving entrances 22,24 as is disclosed in U.S. patent application Ser. No. 07/955,535 filed Oct. 1, 1992.

Referring now to FIGS. 1 to 4, along rear face 32 is defined a wiring indicator, shown as a separate member 60 and having latch arms 62 coextending at opposed ends forwardly from body section 64 to free ends 66 on which are defined inwardly facing latching projections 68. Protruding rearwardly from body section are chambers 70 that when member 60 is affixed to rear face 32 of the assembly, are aligned with respective ones of wire-receiving entrances 22,24. Wire-receiving cavities 72 extend into chambers 70 from forward face 74, and forward portions 76 of walls surrounding the entrances to cavities 72 are adapted to enter into complementary recesses 34 of outer surface portions of housing 12 surrounding wire exits 36 (FIG. 4) upon latching of element 60 thereto with latch projections 68 latching onto forwardly facing latch surfaces 34 defined by housing 12. Wiring indicator element 60 is preferably transparent to enable visual inspection thereinto for verification of the receipt of wire ends into wire-receiving cavities 72 of chambers 70.

Also seen in FIGS. 1 to 4 are wire retainers 90 that are disposed along forward face 74 of element 60, with body sections 92 insertable into slots 78 into forward face 74 of body section 64. Spring arms 94 are joined to body section 92 of each wire retainer 90, extending first forwardly therefrom and then partially bent back at hinges 96 to conclude at free ends 98. Upon mounting of body section 92 into a respective slot 78, spring arms 94 are disposed within respective ones of cavities 72 of chambers 70 of element 60. Preferably free ends 98 are adapted to be spring biased against the far side wall 80 of the respective cavities upon assembly and are adapted to be deflectable toward the near side wall 82 pivotable about hinges 96, as is more clearly seen in FIG. 4.

Figure 4:
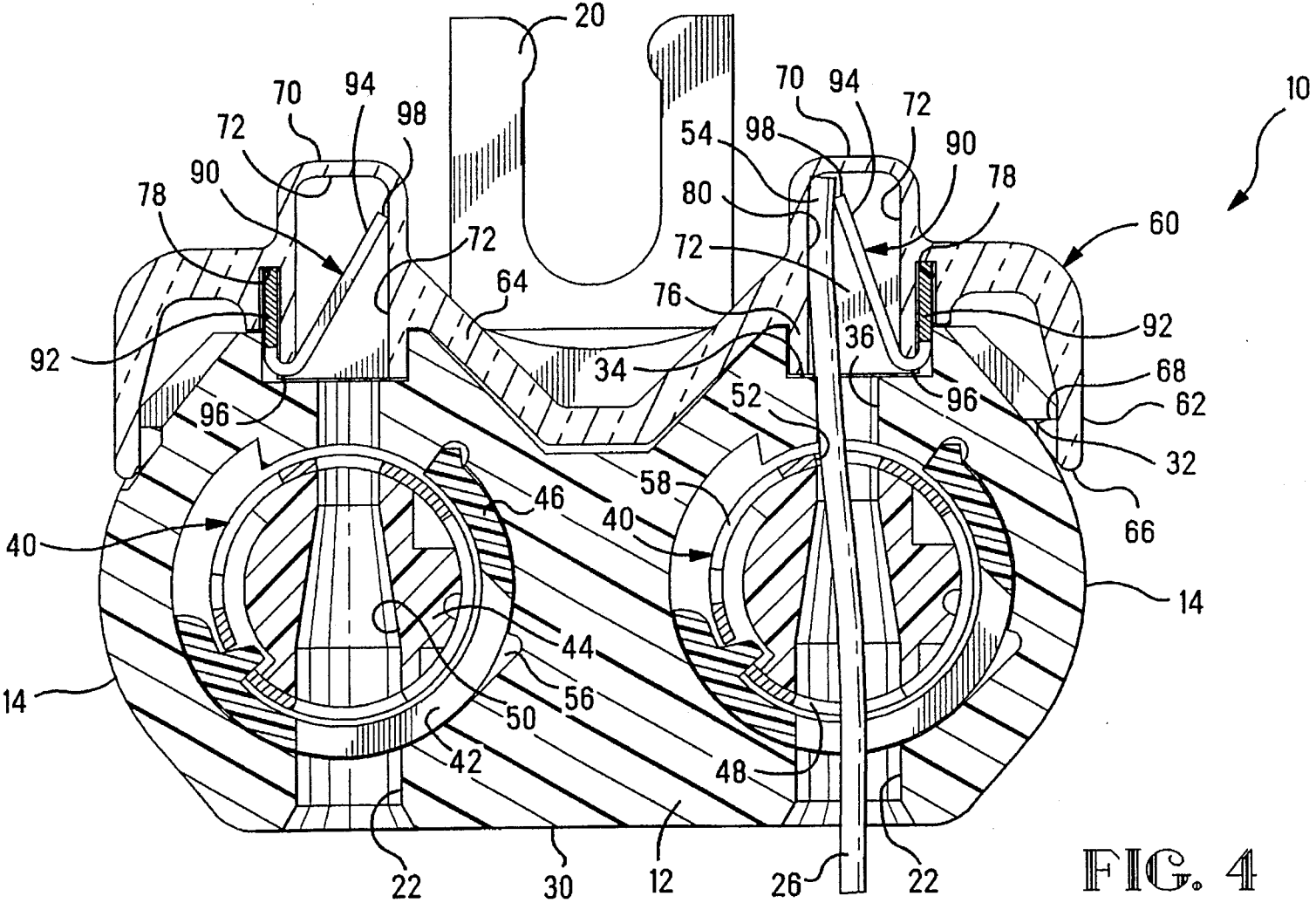
FIG. 4 is a cross-sectional view of the terminal block of FIG. 1 showing one wire fully inserted for termination and entered into the wiring indicator and engaged by the wire retainer of the present invention.

Referring to FIG. 4, the left housing section 14 of terminal block 10 is shown prior to insertion of a wire end thereinto, and the right housing section is shown following full insertion of an end portion of a wire 26 thereinto. Barrel-shaped terminals 40 are shown disposed in annular terminal-receiving cavities 42 of the housing sections around center posts 44. Terminal-engaging actuator section 46 is seen in annular cavity 42 disposed around the terminal, as disclosed in U.S. Pat. No. 5,219,304 and is adapted to engage and rotate clockwise the terminal upon actuation. A wire 26 is shown inserted into wire-receiving entrance 22, through first aperture 48 of terminal 40, through passageway 50 of center post 44, through second aperture 52 of terminal 40 and outwardly through wire exit 36.

Free end 54 of wire 26 is received into a respective wire-receiving cavity 72 of a chamber 70 of element 60, and is shown to have engaged and deflected spring arm 94 of wire retainer 90. As is shown, spring arm 94 possesses sufficient spring strength to urge free end 54 of wire 26 against far side wall 80 and preferably includes a sharp corner to tend to bite into the insulative covering of wire 26 whenever wire 26 is urged by the sealant material in housing section 14 backwardly toward wire-receiving entrance 22 thus resisting the pullout force applied by the sealant. However, it is desirable that the spring strength not be so great as to prevent intentional withdrawal of the wire for repair or replacement. Were wire 26 to be withdrawn for repair or replacement, wire retainer 90 would remain in place to reengage a wire end subsequently urged through the terminal block and into cavity 72 for retermination.

Upon actuation of terminal 40 by the actuator (FIG. 1), the terminal is rotated clockwise, with first slot 56 being urged past wire 26 adjacent first wire-receiving aperture 48 at wire-receiving entrance 22 and penetrating the insulation of the wire, and second slot 58 being urged past wire 26 adjacent second wire-receiving aperture 52 adjacent wire exit 36 and penetrating the wire insulation and also engaging the conductor therewithin. If desired, terminal 40 can be rotated counterclockwise to unterminate the wire allowing wire 26 to be withdrawn and later reinserted and reterminated, or a new wire inserted and terminated.

Wiring indicator element 60 preferably is molded of thermoplastic material and may for example be molded of polyphenylsulphone such as RADEL R-5000 sold by Amoco Performance Products, Inc. Wire retainer 90 may be molded of thermoplastic material and may for example be molded of polycarbonate resin or such as amorphous thermoplastic such as ULTEM 1000 polyetherimide sold by General Electric Company. Alternatively, such a wire retainer could be made of phosphor bronze, for example.

Figure 5:
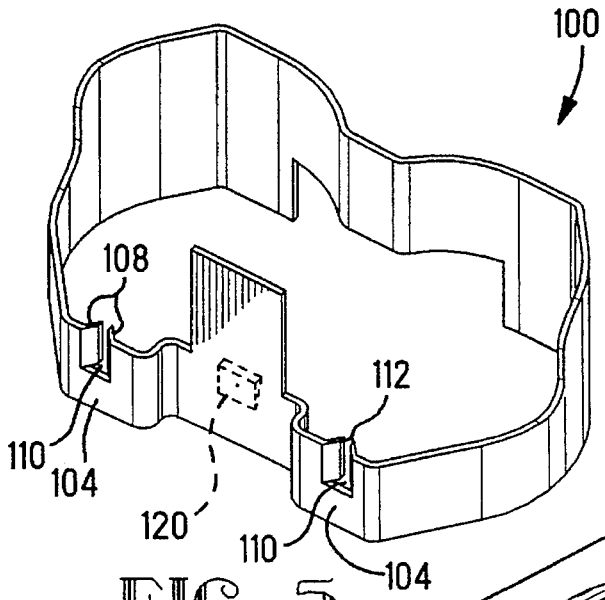
FIGS. 5 to 7 illustrate an alternate embodiment of wire retainer, with FIG. 5 being an isometric view of the clip, FIG. 6 being an isometric view of the clip affixed about a terminal block housing, and FIG. 7 being an illustration of alternate wire-retention section.
Figure 6:
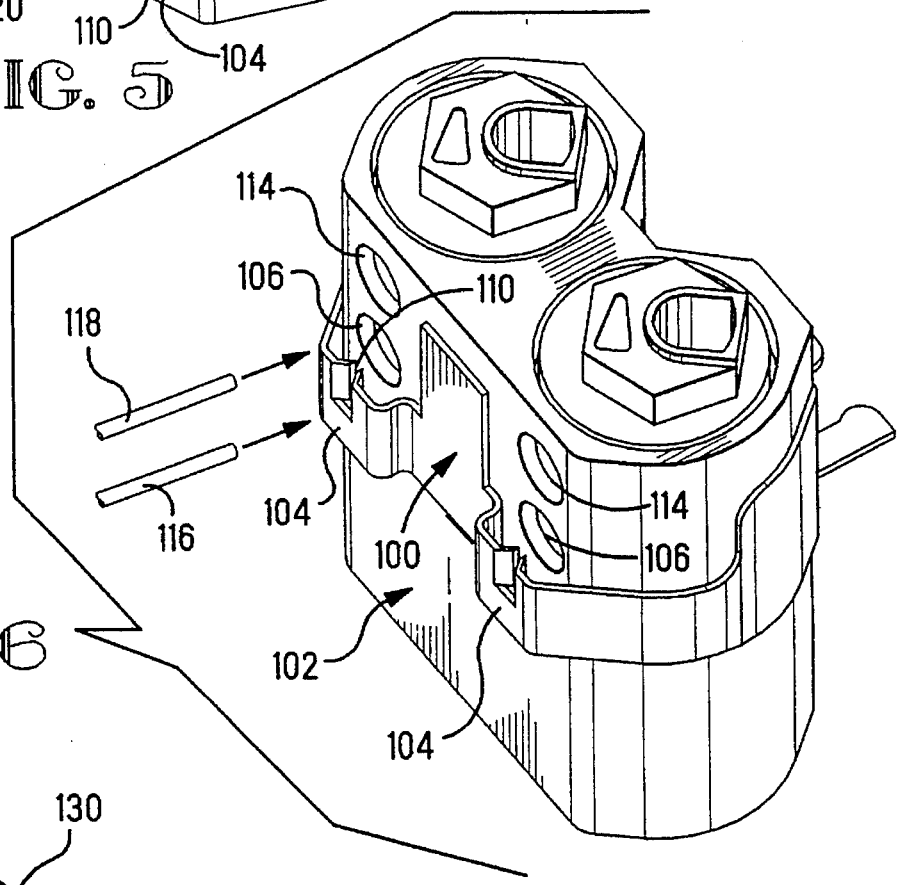
Figure 7:
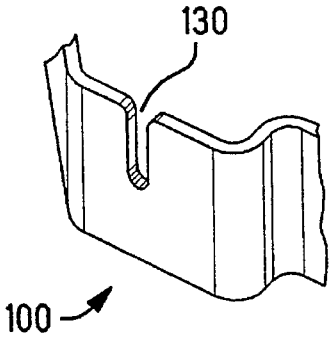

Alternatively, as seen in FIGS. 5 to 7, the biasing means may be a clip 100 securable about the terminal block 102 with wire-retention sections 104 adjacent the wire-receiving entrances 106, comprising a pair of spaced converging tabs 108 extending toward the entrances and defining a constriction 110 at or proximate free ends 112, with the tabs being deflected apart as a wire is urged between them, through constriction 110 and into the entrance 106. Constriction 110 would be selected to be less than a nominal wire diameter, and is capable of being used with larger size wires if necessary, since tabs 108 are deflectable apart. In clip 100, only two wire-retention sections 104 are illustrated, although additional similar sections could be provided for the upper pair of entrances 114; however, with the lower wire 116 being retained by the clip, the upper wire 118 being spliced or interconnected therewith could be manually held in place while the actuator is actuated for termination, as the upper and lower pairs of wires are terminated in sequence. Fastening of the slip to the terminal block housing could be accomplished such as by a latch projection 116 latchable into a complementary recess (not shown) into the outer surface of the housing. Such a wire-retention clip could be molded of plastic such as of polyphenylsulphone.

Wire-retention portion of the clip may also be a slot 130 such as is shown in FIG. 7 having a dimension slightly less than a nominal wire diameter, so that when a wire has been fully inserted into the wire-receiving aperture it may be pressed into slot 130 and thereafter be held therein in interference fit.

Variations and modifications may occur departing in detail from the specific embodiments and examples disclosed herein, that are within the spirit of the inventions and the scope of the claims.

We claim:

1. An electrical connector of the type including wire-receiving openings thereinto for termination of an end of a wire length to a terminal within the connector, comprising:

a housing containing at least one terminal disposed in a terminal-receiving cavity thereof and having at least one wire-receiving aperture thereinto along a wire-receiving face of said housing such that an end of a wire is insertable for termination to said terminal for electrical connection to another conductor; and a wiring indicator disposed on an opposed face of said housing containing at least one chamber extending from the housing and defined by walls of transparent material permitting visual verification that a free end of a said wire is fully inserted through said housing and outwardly through an exit from said terminal-receiving cavity of said housing at said opposed face thereof and associated with each said wire-receiving aperture.

2. An electrical connector as set forth in claim 1 wherein said wiring indicator is a discrete element formed of transparent material and affixable to said housing traversing each said exit, with a wire-receiving cavity of said at least one chamber aligned with a respective said exit.

3. An electrical connector as set forth in claim 2 wherein said housing contains at least one said terminal and has a pair of said wire-receiving apertures associated with each said at least one terminal, and further includes a pair of said exits each associated with a said wire-receiving aperture and opposed therefrom, and said wiring indicator includes a pair of said chambers aligned with each said pair of exits.

4. An electrical connector as set forth in claim 2 wherein said wiring indicator includes a body section adapted to conform to the outer surface of said housing upon being affixed thereto, and further includes a pair of fastening sections for securing said wiring indicator to said housing.

5. An electrical connector as set forth in claim 4 wherein walls defining said wire-receiving cavities of said wiring indicator include forwardly extending portions adapted upon assembly to enter complementary recesses into said rear face of said housing surrounding said wire exits.

6. An electrical connector as set forth in claim 4 wherein a pair of latch arms extend from respective ends of said body section of said wiring indicator toward and to said housing, and latching projections on said latch arms latchingly engage cooperating latch surfaces defined on said housing for affixing said wiring indicator thereto.

7. An electrical connector of the type including wire-receiving openings thereinto for termination of an end of a wire length to a terminal within the connector, comprising:

an assembly including a housing containing at least one terminal disposed in a terminal-receiving cavity thereof and having at least one wire-receiving aperture thereinto along a wire-receiving face of said housing such that an end of a wire is insertable for termination to said terminal for electrical connection to another conductor; and a wire retainer provided within the assembly having at least one wire retention section associated with at least one said wire-receiving aperture such that a portion of a said wire is engaged and retained fully inserted within the assembly by said wire retention section to resist inadvertent retreat of said wire end toward said wire-receiving aperture after full insertion, prior to termination by said terminal.

8. An electrical connector as set forth in claim 7 wherein said wire retainer is proximate an opposed face of said housing in a recess in communication with said terminal-receiving cavity such that a free end of a said wire is fully inserted through said housing and outwardly of said terminal-receiving cavity of said housing at said opposed face thereof opposed from each said wire-receiving aperture, with a spring member engageable by said wire free end and deflected thereby against spring bias and thereafter providing a selected level of spring bias against said wire free end.

9. An electrical connector as set forth in claim 7 wherein said wire retainer is formed of amorphous polyetherimide resin.

10. An electrical connector as set forth in claim 7 wherein said wire retainer is a clip member securable about said housing and including at least one wire-retention section adjacent a respective said wire-receiving aperture of said housing, said wire-retention section including wire-engageable portions adapted to cooperate with a said wire upon full wire insertion into said wire-receiving aperture, to resist rearward movement thereof prior to termination.

11. An electrical connector as set forth in claim 10 wherein said clip member includes at least one latching projection cooperable with a complementary latch recess of said housing, whereby said clip member is latchable to said housing.

12. An electrical connector as set forth in claim 10 wherein said wire-engageable portion comprises a pair of tabs extending toward a respective wire-receiving aperture and converging to define a constriction proximate leading ends thereof of a dimension less than a nominal wire diameter and deflectable apart upon insertion of a wire portion therebetween.

13. An electrical connector as set forth in claim 10 wherein said wire-engageable portion comprises a slot having a dimension slightly less than a nominal wire diameter, adapted to compress insulative covering of a portion of a said wire inserted thereinto upon full insertion into a respective said wire-receiving aperture.

14. Art electrical connector as set forth in claim 10 wherein said wire retainer clip is molded of plastic.

15. An electrical connector of the type including wire-receiving openings thereinto for termination of an end of a wire length to a terminal within the connector, comprising:

a housing containing at least one terminal disposed in a terminal-receiving cavity thereof and having at least one wire-receiving aperture thereinto along a wire-receiving face of said housing such that an end of a wire is insertable for termination to said terminal for electrical connection to another conductor;

a wiring indicator disposed on an opposed face of said housing containing at least one chamber extending from the housing and defined by walls of transparent material permitting visual verification that a free end of a said wire is fully inserted through said housing and outwardly through an exit from said terminal-receiving cavity of said housing at said opposed face thereof and associated with each said wire-receiving aperture; and a wire retainer provided within the assembly associated with each said wire-receiving aperture and proximate an opposed face of said housing in a recess in communication with said terminal-receiving cavity such that a free end of a said wire is fully inserted through said housing and outwardly of said terminal-receiving cavity of said housing at said opposed face thereof opposed from each said wire-receiving aperture, with a spring member engageable by said wire free end and deflected thereby against spring bias and thereafter providing a selected level of spring bias against said wire free end to resist inadvertent retreat of said wire end toward said wire-receiving aperture after full insertion, prior to termination by said terminal.

16. An electrical connector as set forth in claim 15 wherein said wiring indicator is a discrete element formed of transparent material and affixable to said housing traversing each said exit, with a wire-receiving cavity of said at least one chamber aligned with a respective said exit, and said wire retainer is secured within said wiring indicator such that said spring arm is disposed within a respective said wire-receiving cavity of said at least one chamber with said spring arm traversing a wire-receiving path to be engaged by said wire free end upon insertion into said wire-receiving cavity of said chamber and to urge said wire free end against a far side wall of said chamber.

17. An electrical connector as set forth in claim 16 wherein said housing contains at least one said terminal and has a pair of said wire-receiving apertures associated with each said at least one terminal, and further includes a pair of said exits each associated with a said wire-receiving aperture and opposed therefrom, and said wiring indicator includes a pair of said chambers aligned with each said pair of exits, and said wire retainer includes a pair of said spring arms each associated with a respective said wire-receiving cavity extending from a common body section, and said common body section is disposed within a slot extending into said body section of said wiring indicator beside said pair of chambers.

* * * * *